US006354064B1

(12) United States Patent
Meetze et al.

(10) Patent No.: US 6,354,064 B1
(45) Date of Patent: Mar. 12, 2002

(54) STRAW WRAPPING MACHINE AND METHOD

(75) Inventors: Marion Michael Meetze, Chapin, SC (US); Simon Setton, Mississauga; Yves Quintin, Saint Bruno, both of (CA)

(73) Assignee: Glopak, Inc., Montreal (CA)

( * ) Notice: Subject to any disclaimer, the term of this patent is extended or adjusted under 35 U.S.C. 154(b) by 0 days.

(21) Appl. No.: 09/515,958

(22) Filed: Feb. 29, 2000

Related U.S. Application Data

(63) Continuation-in-part of application No. 09/391,011, filed on Sep. 7, 1999, now Pat. No. 6,223,505.

(51) Int. Cl.[7] ..... B65B 9/06

(52) U.S. Cl. ..... 53/450; 53/148; 53/236; 53/550

(58) Field of Search ..... 53/450, 550, 148, 53/236, 578; 221/200, 218, 253; 414/797.6; 198/443, 550.13

(56) References Cited

U.S. PATENT DOCUMENTS 3,312,036 A * 4/1967 Harp ..... 53/182
4,272,944 A * 6/1981 Suga ..... 53/511
4,559,766 A * 12/1985 Matsushita ..... 53/586
5,957,290 A * 9/1999 Stridsberg et al. ..... 206/446

* cited by examiner

*Primary Examiner*—Peter Vo
*Assistant Examiner*—Herman M. Desai
(74) *Attorney, Agent, or Firm*—Carter & Schnedler, P.A.

(57) ABSTRACT

A machine and a method for wrapping an elongated object, such as a drinking straw, with a plastic film are disclosed. The machine has a drive for continuously advancing a thin narrow film strip from a supply roll to a wrapper loading and forming station. The wrapper loading and forming station has a trough former for folding the advancing film strip into a film trough. An inserting device positions spaced-apart elongated objects, such as the drinking straws, into the film trough of the advancing film strip for engagement by the film trough. The objects are supplied by a dispenser and disposed in a pre-oriented manner to be grasped by the inserting device. The film trough is advanced through sealing and severing stations wherein individually wrapped elongated objects or straws are produced.

32 Claims, 12 Drawing Sheets

STRAW WRAPPING MACHINE AND METHOD

CROSS-REFERENCE TO RELATED APPLICATION

This application is a continuation-in-part of application Ser. No. 09/391,011 now U.S. Pat. No. 6,223,505, filed Sep. 7, 1999.

TECHNICAL FIELD

The present invention relates to a machine and a method for wrapping an elongated object, such as a drinking straw, with a plastic film, and to the wrapped object resulting therefrom. More specifically, the invention relates to a straw wrapping machine and method and a straw wrapped in a plastic film wrapper which seals the straw therein. The machine can also be retrofitted quite easily to convert to a paper straw wrapper.

BACKGROUND ART

Straws of all types are packaged in different manners whereby to protect the straw in a sanitary manner to prevent contamination thereof. It is also known to package thermometers in sterilized wrappers. It is still further known to attach short drinking straws on beverage packages or cans with shrink wrappers or other straw attaching films. However, the majority of straws are packaged individually in thin paper wrappers of the type commonly used to manufacture cigarettes. A disadvantage of such wrappers is that they cannot be used to sterilize the straws due to their absorbency. Furthermore, because these papers are highly absorbent, they are susceptible to contamination by liquids should liquid be splashed against the wrapped straw or the straw placed on a liquid spill which we often find on counter tops where drinks of all sorts are dispensed. Another disadvantage of using these thin paper wrappers is that it is difficult to print on these papers. Also, because the paper is highly absorbent, if the wrapped straw was in contact with liquid, the liquid could also dissolve the ink and contaminate the straw inside the wrapper. A further disadvantage is that because these straws are usually made of plastics material, it is difficult to recycle straws in their paper wrappers as the two materials need to be separated for recycling. Accordingly, they are destroyed and not recycled.

SUMMARY OF INVENTION

It is a feature of the present invention to provide a machine, a method and a plastic film wrapped straw which substantially overcomes the above-mentioned disadvantages of the prior art.

Another feature of the present invention is to provide a machine for automatically wrapping straws with a thin plastic film strip which is contained in a roll and wherein the plastic film is a co-extruded film structure with a sealing layer permitting high line speed and a core providing the rigidity and mechanical properties required for good machinability and which permits a substantial increase in film length as compared to paper straw wrappers of the same diameter roll thereby resulting in less frequent machine stoppage for reloading of wrapper strip rolls.

Another feature of the present invention is to provide a method of wrapping straws with thin plastic film strips which is substantially fully automatic and which can handle elongated tubular objects, such as straws, of different dimensions.

Another feature of the present invention is to provide a straw sealed in a thin plastic film wrapper which is waterproof and on which wrapper there is provided printed matter and/or graphics.

Another feature of the present invention is to provide a straw wrapped in a thin plastic film and wherein the straw and wrapper are completely recyclable by the manufacturer.

Another feature of the present invention is to provide a thin plastic wrapper for elongated articles and wherein the wrapper is completely sealed and can be easily sterilized.

Another feature of the present invention is to pre-stretch the film strip to increase the yield of a supply roll and to weaken the film to facilitate the removal of a straw wrapped by said pre-stretched film.

A still further feature of the present invention is to provide a thin plastic film straw wrapping machine which can be easily and economically converted to a paper straw wrapping machine.

According to the above features, from a broad aspect, the present invention provides a machine for wrapping an elongated object with a plastic film. The machine comprises drive means for continuously advancing a narrow thin film strip from a supply means to a wrapper loading and forming means. The wrapper loading and forming means has a trough former for folding the advancing film strip into a film trough. Insert means is provided for positioning spaced-apart elongated objects into the film trough of the advancing film strip for engagement of the objects and conveyance by the film trough. Object dispensing means is provided for supplying pre-oriented elongated objects to the insert means. Sealing and severing means are provided for heat sealing the film trough about individual ones of the elongated objects and severing the film trough between adjacent ends of the elongated objects to form individually wrapped elongated objects.

According to a further broad aspect of the present invention there is provided a method of wrapping an elongated object, such as a straw, with a thin plastic film. The method comprises continuously advancing a narrow thin film strip from a supply roll to a wrapper loading and forming station by drive means. The narrow thin film strip is folded in a trough former to form a film trough having opposed spaced film side walls. Spaced-apart elongated objects are inserted into the advancing film trough whereby each object is frictionally engaged and conveyed by the film side walls of the film trough. A top end portion of the opposed film side walls is longitudinally sealed together with the object thereunder. The folded film trough is then transversely sealed and severed at opposed ends of the object therein and the plastic film wrapped objects are discharged.

According to a still further broad aspect of the present invention, there is provided a straw held captive in a film wrapper formed by a narrow folded plastic film strip defining a trough having opposed side walls between which the straw is held captive between a longitudinal seal adjacent elongated end edges of the side walls and transverse seals spaced from opposed ends of the straw.

According to a further broad aspect of the present invention there is provided an elongated object wrapped in a thin film strip formed by the above described method and apparatus and wherein the elongated object may be a thermometer, stir sticks or any such objects capable of being automatically dispensed in a plastic film trough as formed hereinabove by the described machine and method.

According to a still further broad aspect of the invention the plastic film is a co-extruded polyolefin film structure comprising a sealing layer with a seal initiation temperature lower than 90° C. and a core comprising a mixture of low, medium and/or high density polyethylene and/or polypropylene with an approximate thickness of between 0.5 to 0.7 mil.

According to a still further broad aspect the film strip is stretched by a controlled driven roll unit to increase the yield of a supply thin film roll and to weaken the film to facilitate the removal of a straw wrapped with said weakened film.

According to a further broad aspect of the invention, the plastic film straw wrapping machine is retrofitted to provide a machine for wrapping an elongated drinking straw with a paper strip, said machine comprising drive means for continuously advancing a narrow paper strip from a supply means to a wrapper loading and forming means, said wrapper loading and forming means having a trough former for folding said advancing paper strip into a paper trough, insert means for positioning spaced-apart elongated drinking straws into said paper trough of said advancing paper strip for engagement and conveyance of said straws by said paper trough, straw dispensing means for supplying pre-oriented elongated straws to said insert means, crimping and severing means for crimping said paper trough about individual ones of said elongated straws and severing said paper trough between adjacent ends of said elongated straws to form individually wrapped straws, said trough former having a geometric forming plate with a tapered bottom wall having a flat inlet end and progressively merging opposed side walls tapering to a narrow funnel-like rear trough section, and paper trough drawing means spaced from said funnel-like rear end through section for pulling said paper strip in folded juxtaposition adjacent a top edge of said paper trough formed in said trough former.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
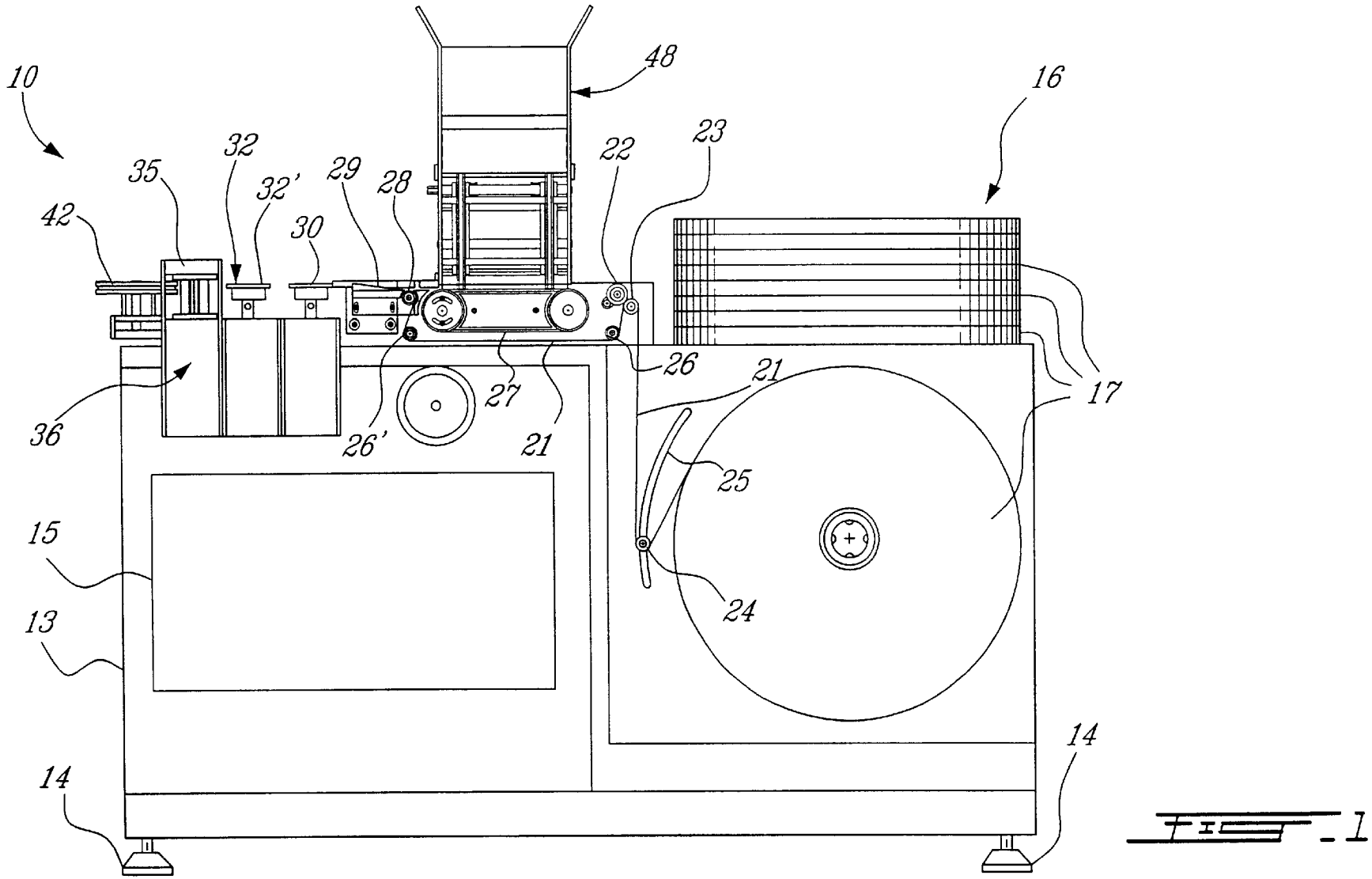
FIG. 1 is a side view of the plastic film wrapping machine of the present invention.
Figure 2:
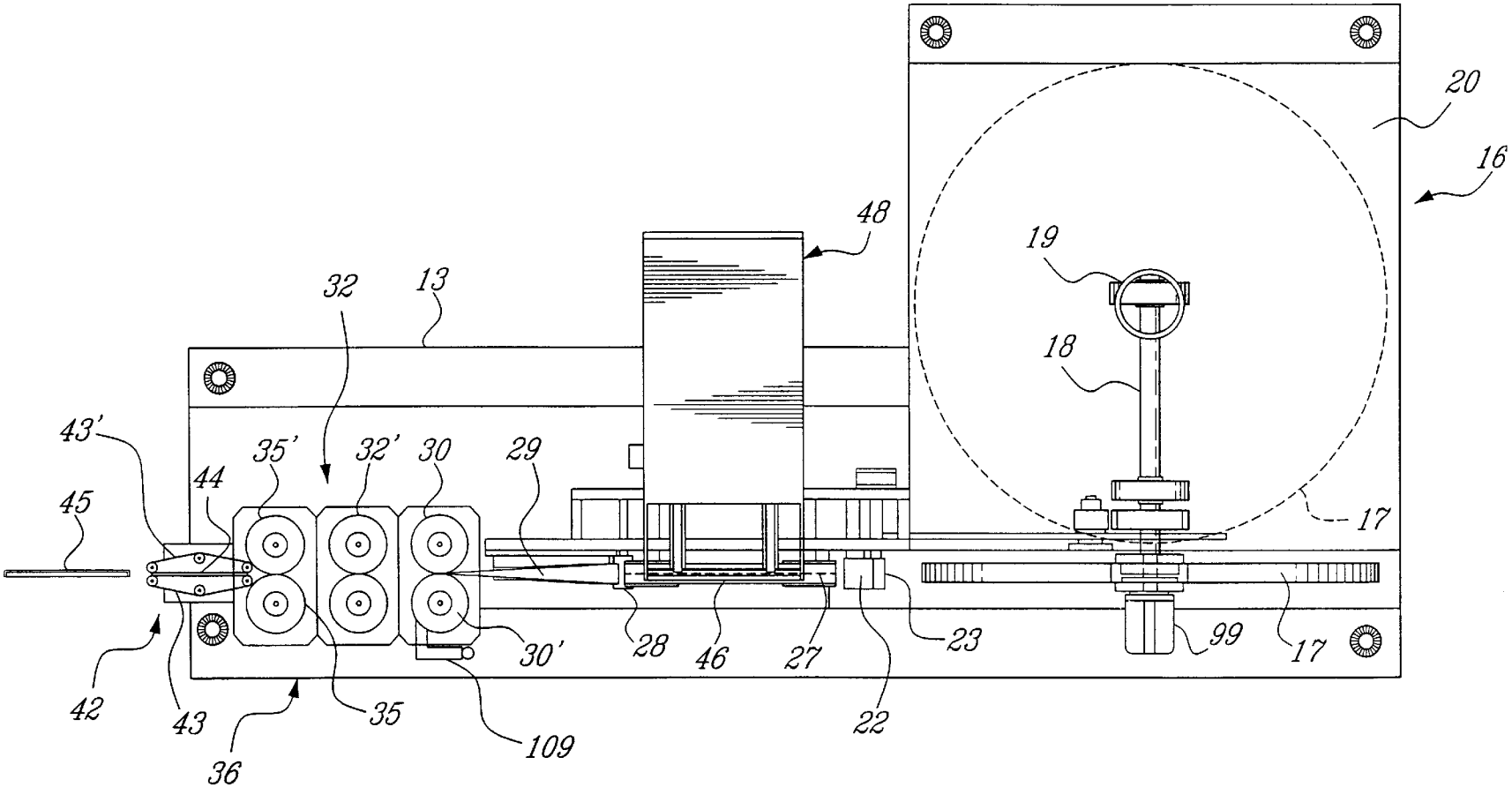
FIG. 2 is a top view of FIG. 1.
Figure 15:
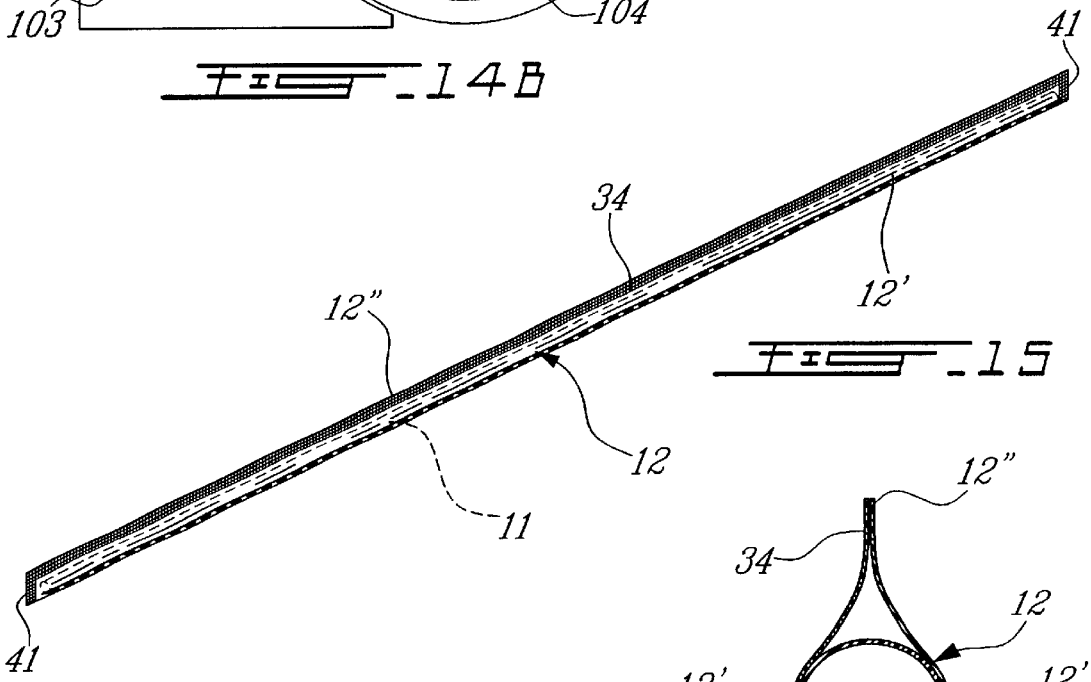
FIG. 15 is a perspective view showing a straw wrapped in a thin film plastic strip formed in accordance with the present invention.
Figure 16:
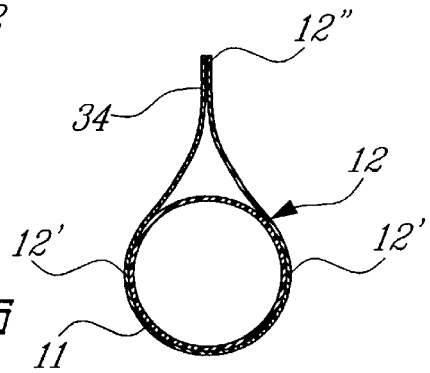
FIG. 16 is a transverse section view of FIG. 15.

Referring now to the drawings and more particularly to FIGS. 1 and 2, there is shown generally at 10 the machine of the present invention for wrapping an elongated object, such as a drinking straw 11, as shown in FIGS. 15 and 16, in a thin plastic film wrapper 12. The machine has a housing 13 which is supported on adjustable legs 14 whereby the machine can be leveled. The machine is also provided with a control panel 15 which houses switches, counters, temperature controllers, machine speed indicators, etc. At a supply end 16 of the machine, there is provided a thin plastic film strip roll 17 which is supported on a support shaft assembly 18. A cylindrical flange 19 is secured to the top wall 20 of the housing at the supply end and a plurality of the film rolls 17 are stored about this cylindrical flange for reloading the machine once the dispensing roll needs to be replaced.

As hereinshown, the thin plastic film strip 21 is trained about various guide rolls and is drawn by a drive feed roll 22 which is spring-biased against an idler roll 23. The film strip 21 exiting the film roll 17 is first trained about a tension roller 24 which is secured to a pivot arm, as will be described later. The tension roller 24 is displaceable in an arcuate guide slot 25 for reasons which will also be described later. The film strip exiting the drive feed roll 22 is trained about a pair of guide rolls 26, 26' which are disposed under an article loading conveyor 27. The thin film strip 21 then passes over an inlet roll 28 of a trough former 29 where the thin film strip 21 is folded into a trough for receiving an elongated object, such as the straw 11 therein.

Figures 3A, 3B:
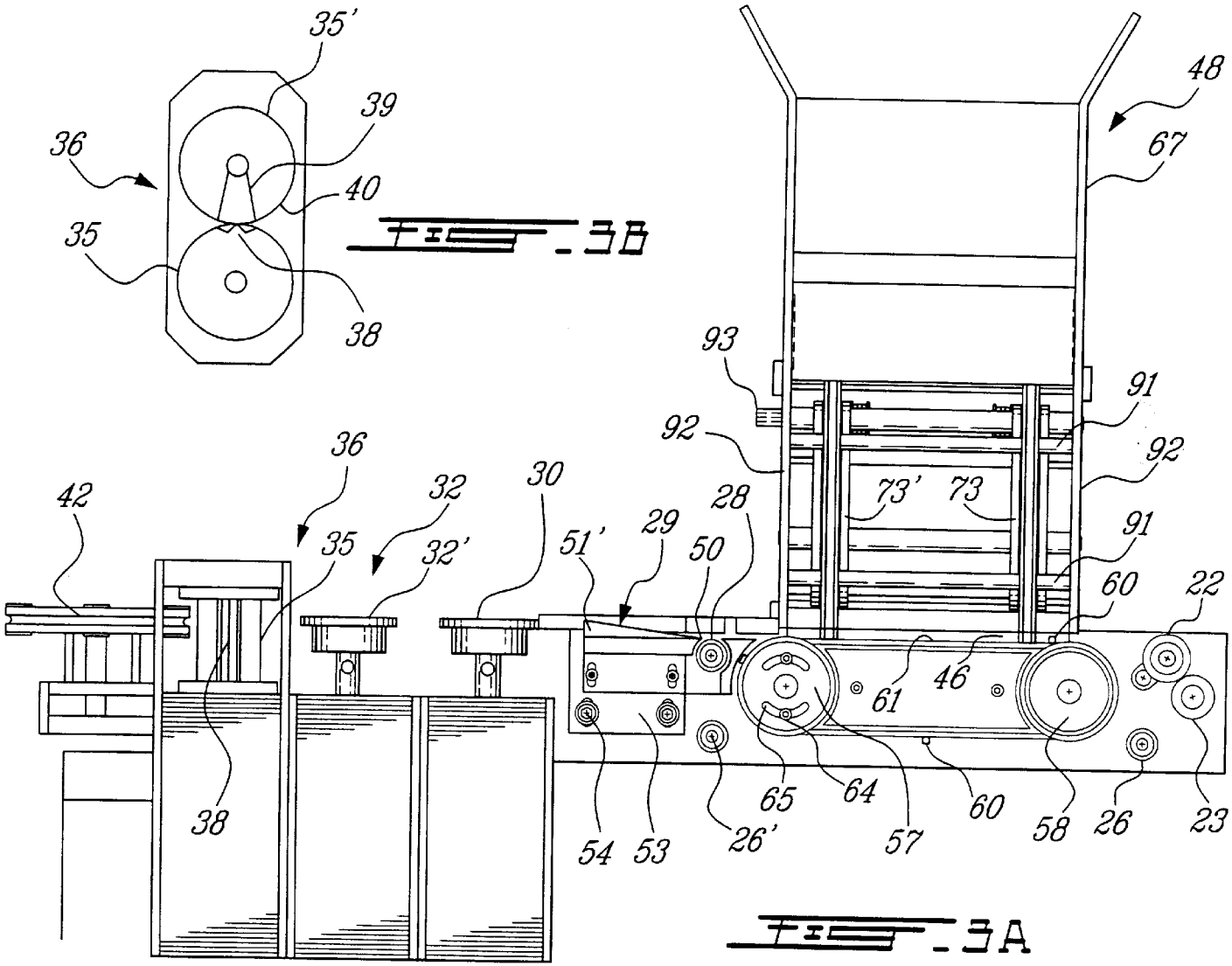
FIG. 3A is an enlarged side view of a portion of FIG. 1 to better illustrate the construction and operation of the wrapper loading and forming stations.
FIG. 3B is a top view of the vertical sealer and severing roll assemblies.

At the outlet of the trough former, the free top end portions 12" of the opposed side walls 12' of the folded film strip are held captive between a set of draw rolls 30 driven by a belt which is synchronized to the drive feed roll 22 whereby to draw the film trough engaged in a closed folded position with the straw captive therein and disposed under the engaged top free end 12" of the wrapper, as shown in FIG. 16. This top fee end 12" is also engaged by a set of heat sealing disc flanges 32' of the sealer 32 and which are also rotatably driven by a further belt drive, also synchronized with the drive feed roll 22 and draw rolls 30. The sealing disc flanges 32' are heated to a predetermined temperature to form an elongated seal 34 between opposed side walls 12' of the film wrapper 12 below the top free ends 12", and transverse end seals 41 as shown in FIG. 15. The film trough is then engaged between another set of driven drums 35 of an anvil 39 and knife 38 assembly 36 (see FIG. 3B) which is also driven by a belt synchronized with the other belts and the drive feed roll 22.

With further reference to FIG. 3, the vertical anvil and knife assembly 36, as previously described, is comprised of a pair of drums 35 and 35' with drum 35 being provided with a vertical cutting blade or knife 38 extending at a predetermined location and oriented on a vertical axis on the surface of the drum 35. This cutting edge or blade 38 is disposed to contact the anvil 39, disposed on the drum 35' and positioned at a predetermined location on its outer circumference 40 and aligned for registry with the cutting blade 38 whereby to sever the film trough between opposed ends of adjacent straws being conveyed by the trough and to simultaneously form a vertical end seal 41 at both the trailing end of a forward straw wrapper and the leading end of a trailing straw wrapper. The folded film trough is drawn from the cutting head assembly 36 by a pair of discharge conveyors 42 which, as better seen from FIG. 2, is comprised by two endless belts 43 and 43' and which form a discharge throat 44 by opposed straight runs of the belt to engage therebetween the top end portions 12" of the film wrapper 12 having been completely sealed about the straw 11 and discharged from the cutting head assembly 36. The straw 11 in its wrapper 12, as shown at 45, is then ejected by the discharge conveyor 42 into collecting bins, not shown, or other form of collator for packaging these film wrap straws.

Figure 4:
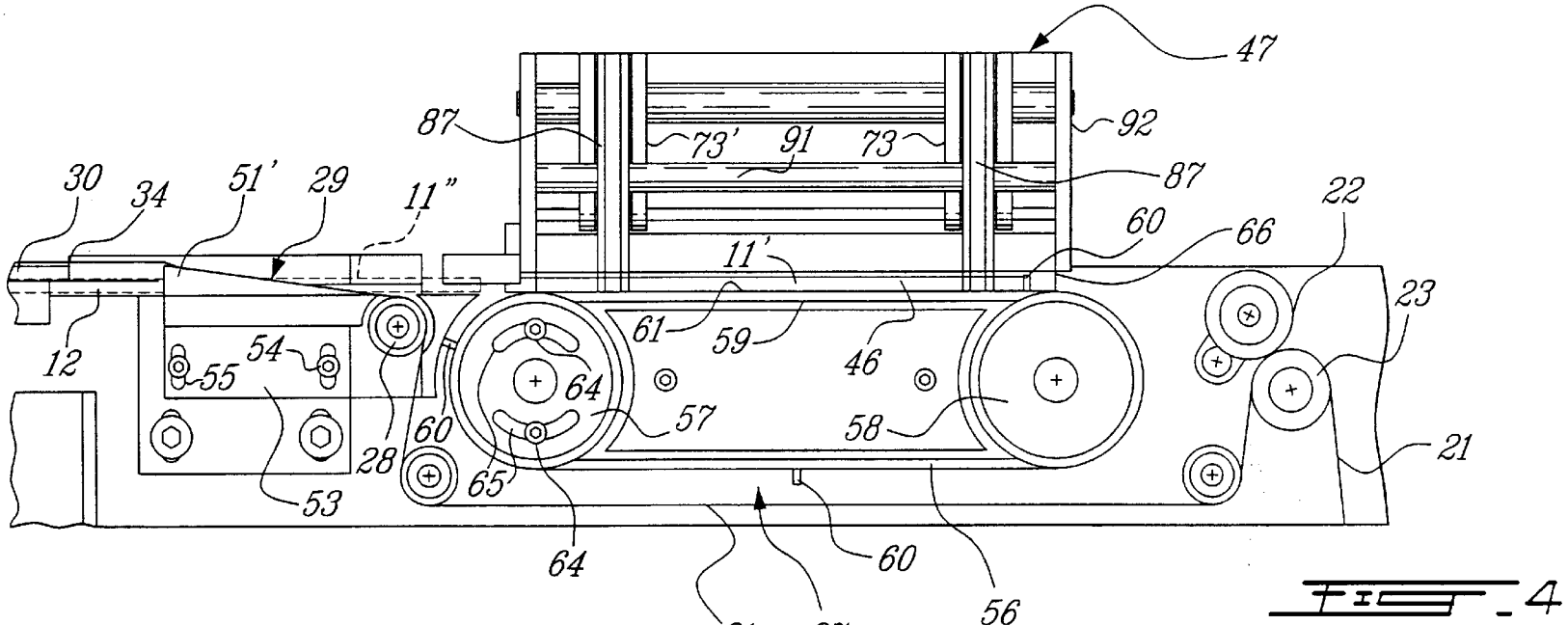
FIG. 4 is a still further enlarged view of a section of FIG. 3 showing the discharge end of the straw holding bin in relation to the endless belt straw inserter and its position relative to the trough former.
Figure 5:
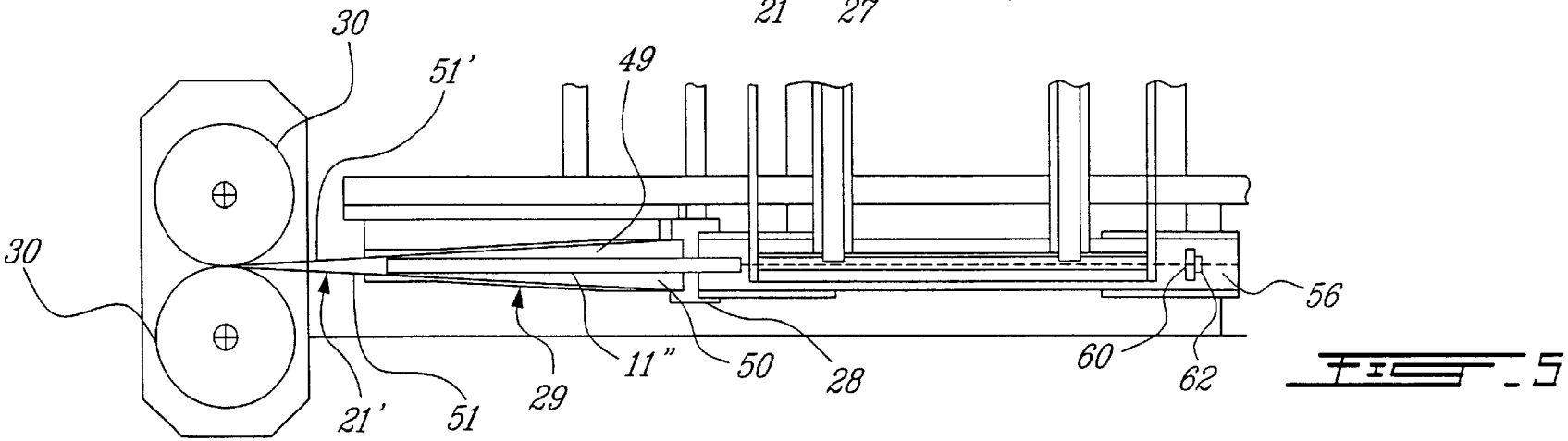
FIG. 5 is a top view of the straw former and its relationship with the endless belt straw inserter.
Figure 6:
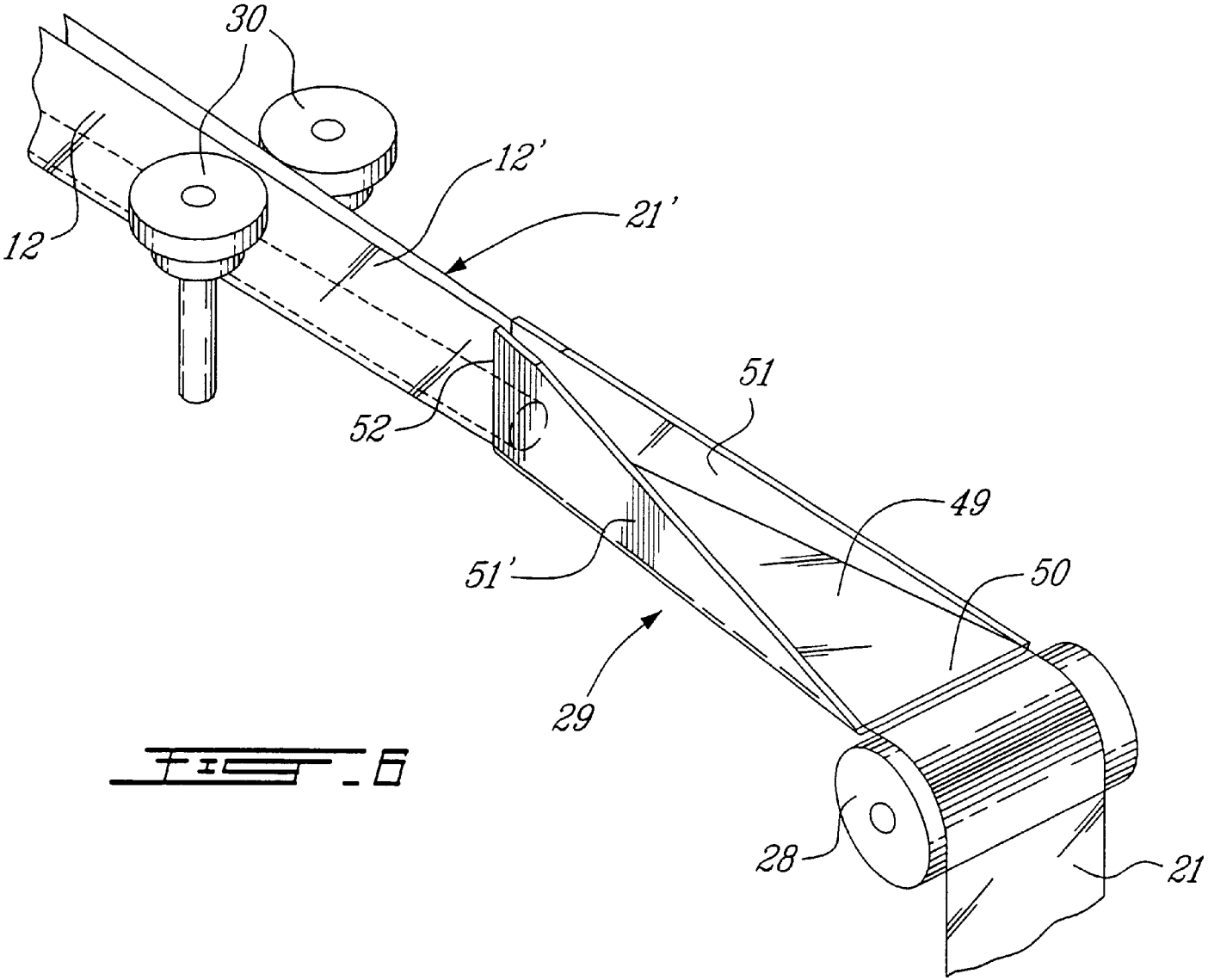
FIG. 6 is a perspective view of the plastic film trough former.

Referring now more specifically to FIGS. 4 to 6, there will be described the construction and operation of the trough former 29 and the loading conveyor 27 which dispenses straws from a discharge end 46 of a straw holding magazine 47 of a straw supply bin 48 as shown more clearly in FIG. 1. As better seen from the perspective view illustrated in FIG. 6, the trough former 29 is comprised by a geometric forming plate which defines a tapered bottom wall 49 having a flat wide inlet end 50 and progressively merging opposed side walls 51 and 51' tapering to a narrow funnel-like U-shaped rear trough section 52. The film draw rolls 30 are spaced from the rear end trough section 52 and pull the film strip 21 in folded juxtaposition to progressively form a film trough 21' within he forming plate and in which straws 11 are positioned. As clearly shown in FIG. 6, the draw rolls 30 are narrow rolls and engage only the top end portions of the folded film trough 21' whereby the straw 11 can be conveyed below the narrow draw rolls 30 as it pulls the film trough 21' through the plate former 29. As the film moves into the trough former, the side walls 12' of the film come closer together to form a straw engaging section intermediate the flat end 50 and the rear trough section 52 whereby when a straw is disposed in the trough former, the side walls 51, 51' of the film will frictionally engage a leading end of the straw 11 loaded therein by the loading conveyor 27 and convey it, as better seen from FIGS. 4 and 5.

As shown in FIG. 4, the geometric forming plate 29 is secured to an adjustable positioning flange 53 which is secured by bolts 54 extending into respective slots 55 of the flange whereby the position of the trough former 29 can be adjusted up and down and in relation to the inlet roll 28 whereby to ensure proper operation of the trough former to receive the particular objects being dispensed by the loading conveyor 27.

The loading conveyor 27 is comprised of a narrow endless belt 56 which is rotatably driven between a drive sheave 57 and an idle sheave 58. The endless belt has a flat run section 59 which is disposed adjacent the straw discharge end 46 of the straw dispensing magazine 47 and is herein provided with three pusher plates 60 secured to the top surface 61 of the endless belt 56 in spaced-apart relationship and disposed a predetermined distance between one another. The pusher plates have a straw end engaging front wall for pushing a straw, such as straw 11' at the discharge end 46, into the trough forming plate 29, as shown in FIG. 5. As the front end of the straw 11' moves into the trough forming plate 49, it will be frictionally engaged by the opposed side walls of the film trough 12 and will be grasped thereby and pulled through the trough former along with the film trough 21'. The pusher plates 60 are provided with an attachment lug 62 which constitutes an adjusting means to secure the position of the pusher plates along the top surface 61 of the endless belt 56 at predetermined distances dependent on the length of the objects, herein straws 11, being loaded in the film trough.

As previously described, the machine can also be adapted to load different elongated objects into the film trough 21 such as, for example thermometers, stir sticks, etc. As hereinshown, the drive sheave 57 is also secured to its drive shaft 63 through an adjustable connection comprised of bolts 64 extending in arcuate slot 65 formed in the sheave disc. This permits the adjustment of the belt and therefore the pusher plates 60 to position the plates at precise locations with respect to the trailing end position 66 of a straw 11' located at the discharge end 46 of the magazine prior to the operation of the machine. Accordingly, the loading conveyor is also synchronized with the drive feed roll 22 and the motors 31, 33 and 37.

Referring now to FIGS. 7 to 11, there will be described the construction and operation of the straw supply holding bin 48. The straw supply holding bin 48 is formed by spaced-apart parallel side walls 67, a front wall 68, a rear wall 69 and a bottom wall 70. A straw feed and alignment mechanism 71 is provided and forms a portion of the bottom wall in a discharge area thereof. This mechanism 71 is comprised of a discharge conveyor 72 which is provided by an endless belt 73 which has a serrated upper surface formed by a plurality of rib formations 74 or other means, as better illustrated in FIG. 9, wherein to frictionally engage on its surface the straws 11 which are disposed within the bin and transversely aligned between the side walls 67. Supply means, not shown, is provided to position straws within the bin and this can be done manually or by other automatic loading means.

The bin bottom wall 70 is an inclined wall whereby to direct the straws towards the discharge conveyor 72. A further discharge conveyor 75 is also coupled to the drive sheave of the discharge conveyor 72 to feed the straws to the discharge conveyor 72 to position the straws into a positioning throat section 77 where the straws are oriented in perfect side-by-side parallel spaced relationship.

Figures 8, 9:
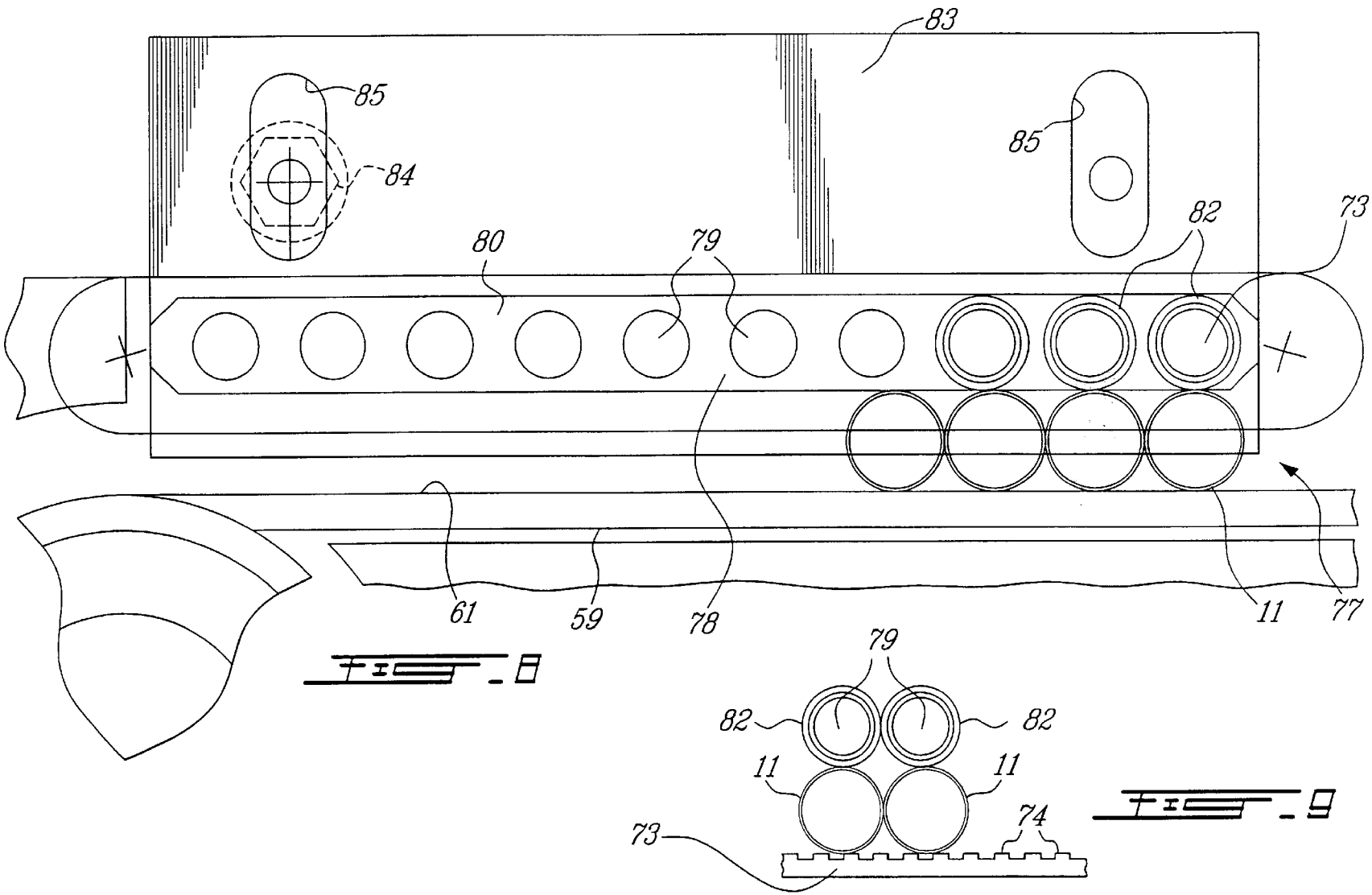
FIG. 8 is an enlarged view of the horizontal throat section adjacent the discharge conveyor.
FIG. 9 is a fragmented side view showing a section of the horizontal throat section of a discharge conveyor in relation to the buffer wall.

With further reference to FIG. 8, it can be seen that the positioning throat section 77 is defined by a stationary buffer wall 78 retained in spaced parallel relationship with at least a section of the upper surface 74 of the discharge conveyor 72. This buffer wall 78 permits the straws 11 to align themselves in the said side-by-side parallel spaced relationship.

The buffer wall 78 is comprised by a plurality of spaced rods 79 which are secured to a frame 80 and held in spaced-apart parallel relationship and at a predetermined distance therebetween. These rods 79 lie in a common plane which is disposed substantially parallel to the friction upper surface 74 of the discharge conveyor belt which has a straight flat run section 59 disposed thereadjacent. A flexible hollow tubular member 82, which is herein constituted by a straw is disposed about each of the rods 79 in loose spaced relationship therewith. That is to say, the inner diameter of the tubular member 82 is much larger than the outer diameter of the rod 79 so that the tubular members 82 can move up and down and sideways and provide a buffer for the straws 11 being conveyed on the upper surface 61 of the flat run section 59 permitting the straws 11 to align themselves.

The frame member 80 holding the rod 79 is secured to an adjustable flange wall 83 which is adjustable up and down to vary the distance between the tubular rod 79 and the upper surface 61 of the straight run section 59 of the discharge conveyor 72. The flange wall 83 is secured by bolts 84 which extend through elongated slots 85 to provide this adjustment.

It is pointed out that the discharge conveyor 72 is rotating at a speed slightly higher than the speed of the loading conveyor 27 to ensure that the discharge magazine 47 is always full of straws. Accordingly, as the straws enter the positioning throat section 77, the upper surface of the conveyor 61 will keep pushing on the straws and they will move slightly up and down and align themselves in a side-by-side relationship as shown in FIG. 8 as they are free to move up against the flexible tubular members or straws 82 which will also move up and down on their support rods. Therefore the serrated upper surface of the endless belt 73 will slip under the straws when the trough and magazine is full but continue to move the straws in the discharge magazine immediately as straws are discharged from the discharge end 46 thereof.

Figure 7:
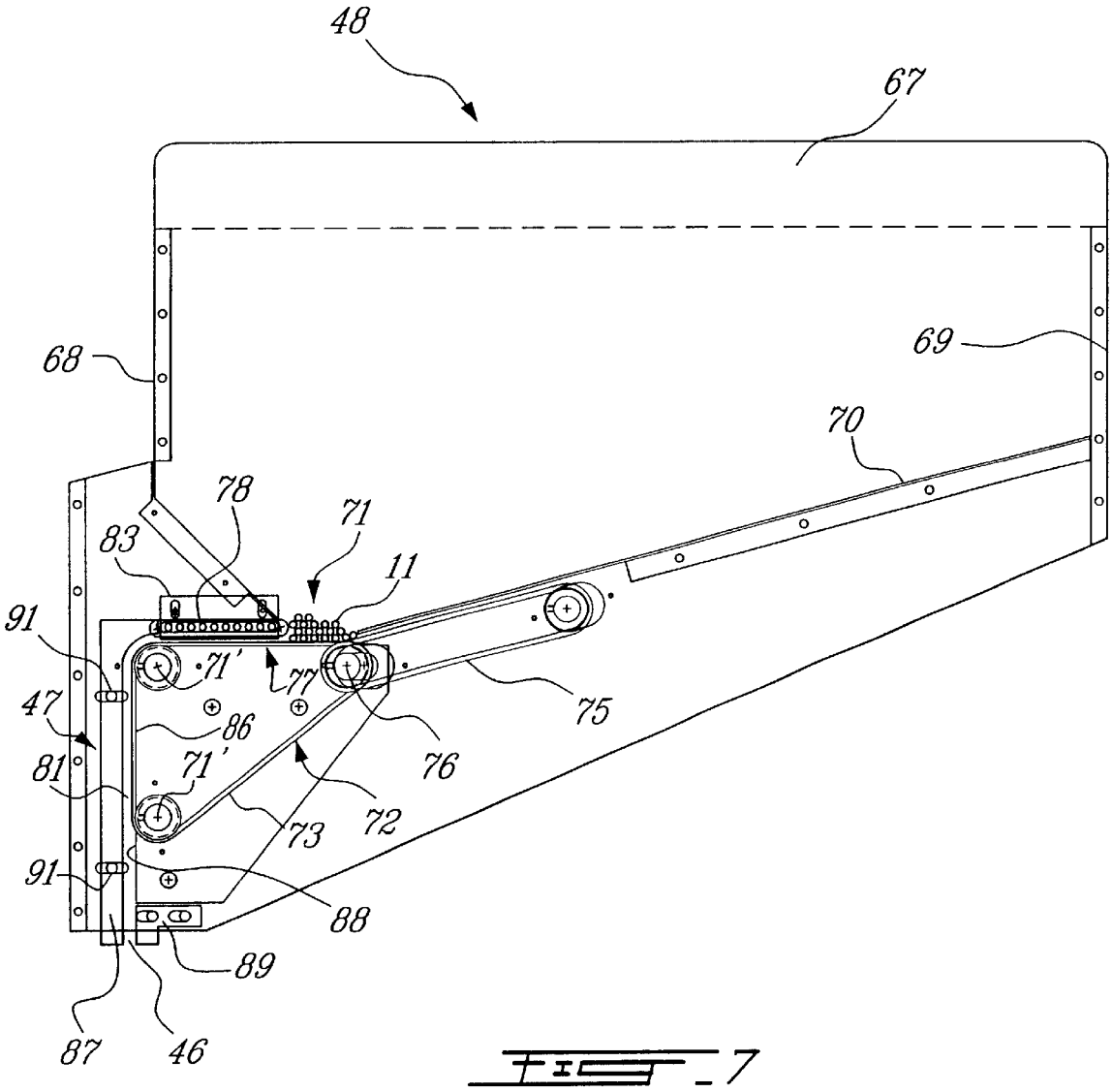
FIG. 7 is a side view showing the construction of the holding bin with its straw feeding and alignment mechanisms to position the straws in side-by-side parallel relationship in a discharge magazine.
Figure 10:
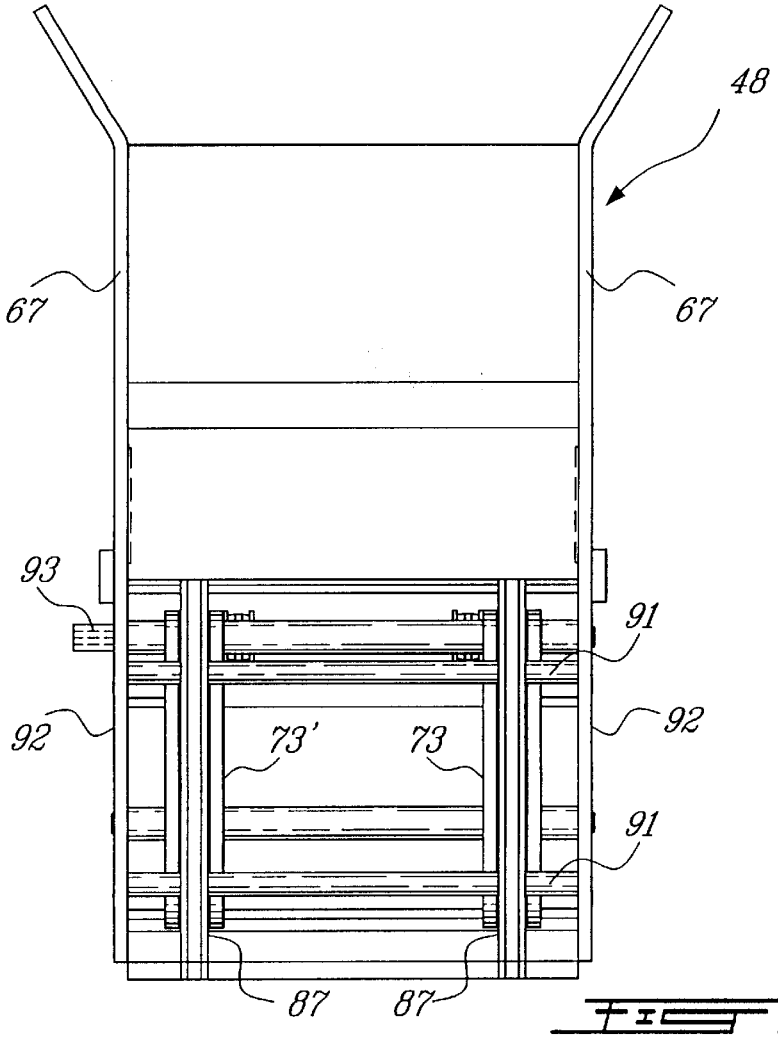
FIG. 10 is a front end view of the holding bin and the storage magazine leading to the straw discharge end.
Figure 11:
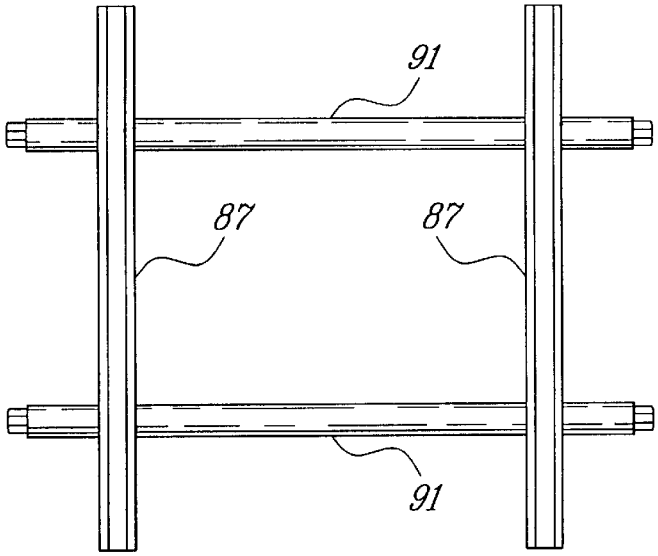
FIG. 11 is an end view showing the construction of the adjustable outer wall of the magazine section of the holding bin.

With reference now to FIGS. 7, 10 and 11, there will be described the construction of the magazine. As hereinshown, the magazine is constituted by a lower vertical discharge section 81 of the bin 48. At the upper end of the magazine 47, the endless belt 73 is displaced along a straight vertical travel path 86 which extends substantially transverse to the horizontal straight run section 59 under the buffer wall so that straws will be continuously pushed into the magazine 47. The magazine 47 is provided by adjustable straw restraining walls 87 and a stationary lower wall section 88. An opposed adjustable plate 89 is provided below the lower wall section 88 to adjust the width of the discharge end 46, depending on the size of the straws being packaged. Similarly, the straw restraining wall 87 is adjusted.

Figure 12:
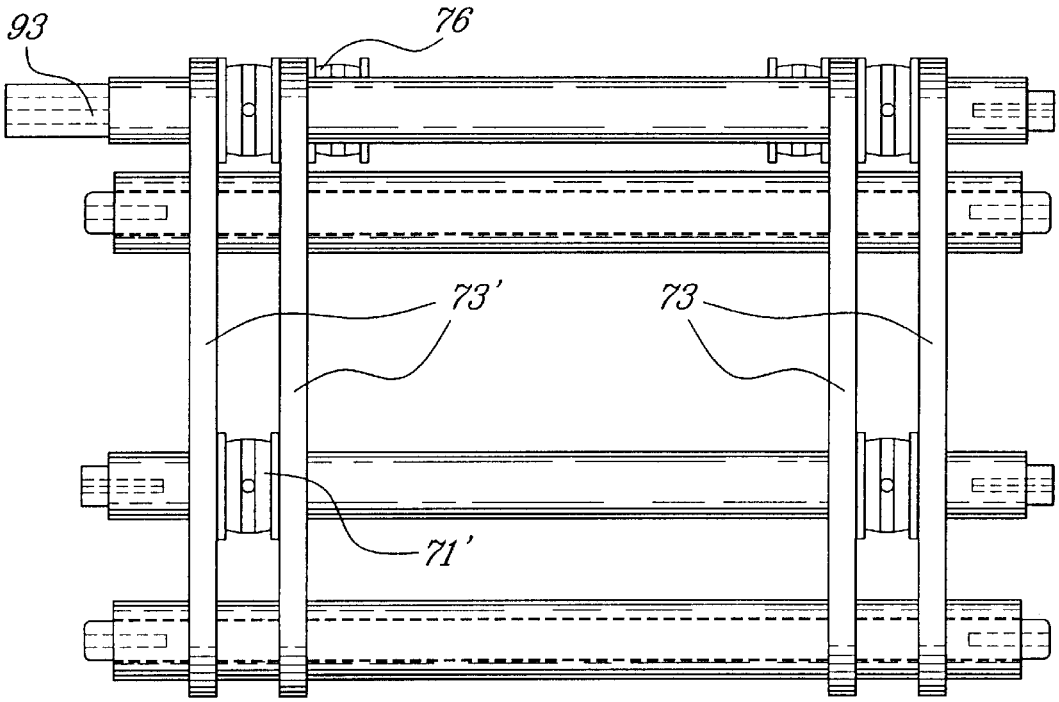
FIG. 12 is a side view showing the construction of the conveyor and its drive.

As shown in FIGS. 10 and 11, the straw restraining walls 87 are comprised of a pair of spaced-apart guide plates 90 which are retained in vertical parallel relationship by adjustable support rods 91 which are secured between side frame members 92, as shown in FIG. 10. These guide plates 90 are brass plates which are adjustably positioned relative to the vertical discharge section 86 of the discharge conveyor and depending on the outer diameter of the straws being loaded into the magazine. As also better seen from FIG. 12, the discharge conveyor is constituted by two narrow endless belts 73 and 73' trained about the drive sheave 71 and idle sheaves 71'. The drive shaft 93 of the drive sheave 76 extends outwardly of one of the side walls 67 of the bin for coupling to a drive motor (not shown) which is synchronized with the other drives as above-described.

Figure 13:
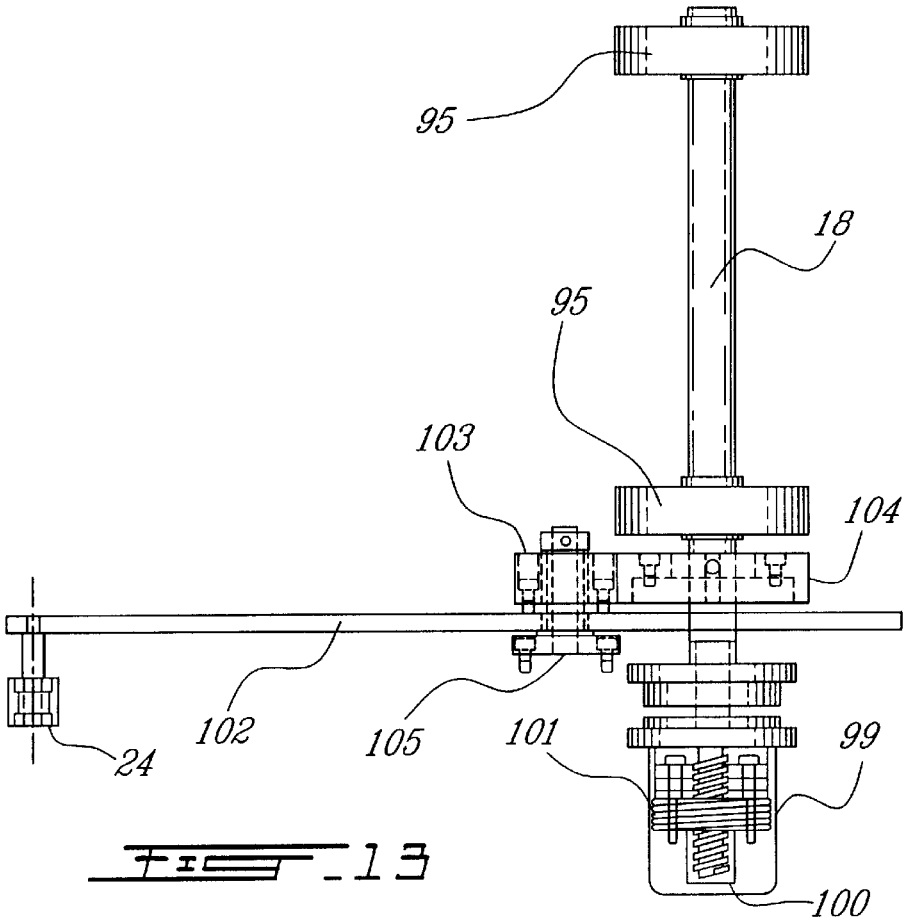
FIG. 13 is a top view illustrating the construction of the film roll holder and automatic braking system.
Figure 14A:
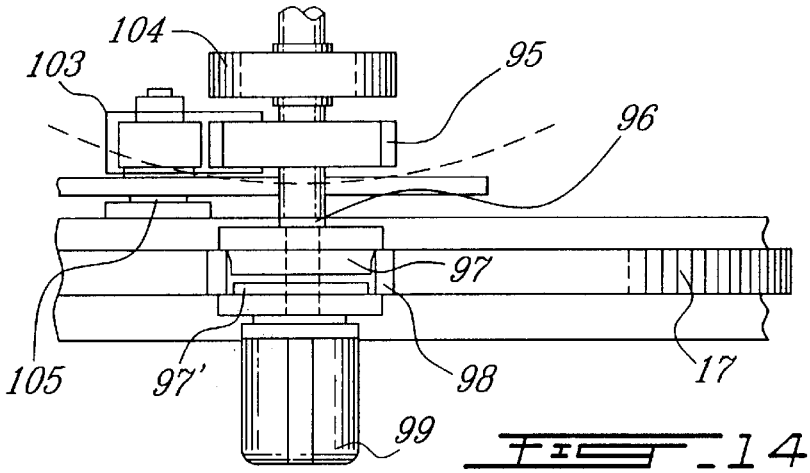
FIG. 14A is an enlarged view showing the construction of the film core lock assembly and the position of the brake shoe in relation to the brake hub secured to the film roll core support shaft.
Figure 14B:
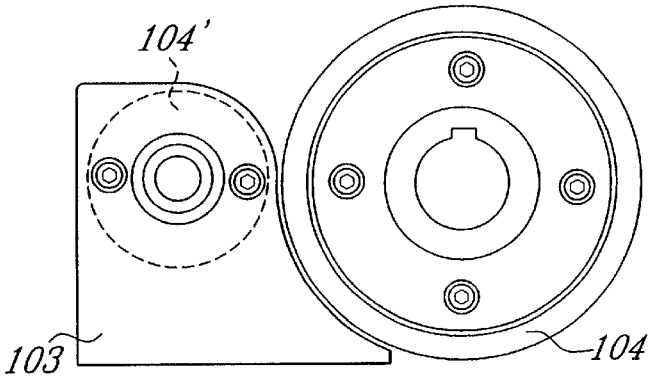
FIG. 14B is a side view of the brake shoe in relation to the brake hub secured to the film roll support shaft.

Referring now to FIGS. 2, 13 and 14A, there is shown the construction of the support mechanism for the film roll 17 which feeds the machine. As hereinshown, the support mechanism is comprised of the support shaft 18 secured between pillow blocks 95 disposed inside the machine housing 13. The support shaft is freely rotated within the pillow blocks 95 and has a connecting free end section 96 extending outside the housing and to which a core chock 97 is removably secured. The core chock 97 is selected to engage the specific film core 98 of the film roll 17 being dispensed. Another core chock 97' is secured to a core lock ratchet cap 99 which is secured to the threaded free end 100 of the free end section 96 of the support shaft 18 whereby to clamp the film core 98 between the chocks 97, 97'. The ratchet cap 99 is provided with an internal ratchet connection 101 which ensures proper clamping pressure on the core to prevent slippage and the cap from disconnection during high-speed operation of the film roll 17. As can be appreciated, as the film roll becomes smaller and smaller in diameter, the speed of the shaft increases. However, to control the speed of the shaft to maintain proper tension on the film, there is provided the tension roller 24, which is displaceable in the arcuate slot 25 and this tension roller 24 is connected to a tension control pivot arm 102 which has a brake shoe 103 for releasable engagement with a brake hub 104 which is secured to the support shaft 18, as can be seen from FIGS. 13 and 14A. The tension roller 24 is displaceable in the arcuate slot 25 on a pivot connection 105 located adjacent the brake hub 104. Accordingly, the weight of this pivot arm 102 will maintain the tension roller biased downwardly within the arcuate slot 25 against the film strip 21. As the machine drive slows down, the film roll has a tendency to keep turning at a higher speed and this will cause the tension roller 24 to start moving down within the arcuate slot on its pivot 105 causing the steel brake shoe 103, as shown in FIG. 14B, to move against the drum and slow down the speed of the support shaft 18. A roller 104 is engageable with the brake hub to limit the displacement of the brake shoe 103.

With the above dispensing mechanism we have found that large thin narrow film rolls of polyolefin co-extruded film structure comprising a sealing layer with a seal initiation temperature lower than 90° C. and a core comprising a mixture of low, medium and/or high density polyethylene and/or polypropylene with an approximate thickness of between 0.5 to 0.7 mil is a suitable film spec for use with this machine. This is a water-proof film on which printed matter can be printed therealong.

With reference to FIG. 1, the method of operation of the machine will be briefly summarized. A narrow thin film roll 17 is placed on the support shaft 18 and locked therein by the ratchet cap 99. The thin film strip 21 is trained about the tension roll 24, over the idler roll 23 with the drive feed roll 22 having been sprung back. The film then extends in a lower travel path under the loading conveyor 27 between a pair of guide rolls 26 and 26'. The film is then positioned up on the inlet roll 28 and through the trough former 29 at the end of which the film is folded in half. As shown in FIG. 2, one of the draw rolls 30, herein roll 30' has a cam operated mechanism 109 secured thereto to draw the roll 30' away from the stationary draw roll 30 to permit threading the folded film strip and more specifically the upper free end edge portions of the opposed side walls of the folded film through the draw rolls. The heat sealing discs 32 are provided with a pneumatic roll separating mechanism, not shown herein, and these are also opened so that both heated rolls 32' separate to permit the folded film strip 21' to be passed therebetween without engaging the heated rolls. The film is advanced to the first set of wheels 30 during start up.

The film will self-feed through the heated section 32 as the machine starts. The loading conveyor pusher arms 60 are also adjusted with respect to the article at the discharge end of the magazine and the machine is ready for operation. The draw rolls 30 are closed so the machine can be started wherein immediately thereafter the sealing discs 32' are closed as well as the vertical sealing and severing assembly 36. This results in some waste of film material and straws at the beginning of the run. However, because both the film and the straws are made of compatible polyolefin materials, they are easy to recycle as there is no need to separate them. As previously described, the straws are ejected by the discharge conveyor 42 into holding bins or discharge conveyors (not shown) for packaging.

As shown in FIGS. 15 and 16, there is thus formed a straw which is held captive in a thin film wrapper 12 formed by a narrow folded plastic film strip defining a trough having opposed side walls 12 and 12' and between which a straw 11 is held captive between a longitudinal seal 34 formed adjacent elongated top end edges 12" of the film side walls 12' and transverse end seals 41 formed at opposed ends of the straw 11.

Figure 17:
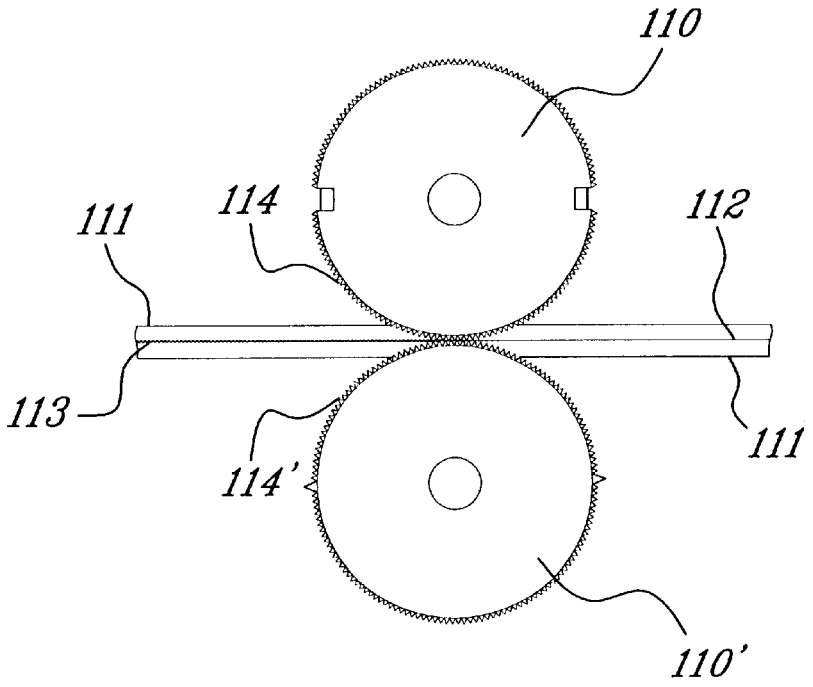
FIG. 17 is a top view of paper crimping rolls which replace the heat sealing disc when the machine is retrofitted as a paper straw wrapper.

An important feature of the plastic film straw wrapping machine described is that it can be easily, quickly and economically converted to a paper straw wrapper. Accordingly, the machine may serve a dual purpose. To convert to a paper wrapping machine, a roll of paper is substituted for the plastic film roll 17 and may be mounted on a different roll support chuck. The draw rolls 30 can be changed to suit a paper strip. The heat to the sealing discs 32' is switched off and the sealing discs are replaced by paper crimping discs 110 and 110', as shown in FIG. 17. The paper strip 111 is folded by the trough former 29, the same way as the plastic film strip and a straw is held captive therein. The free top end portion 112 of the folded paper strip extends juxtaposed in contact above the captive straw and engaged between the two crimping discs 110 and 110' wherein the top edge 112 is engaged by crimps 113 formed therein by the teeth 114 and 114' about the circumference of the discs 110 and 110'.

Figure 18:
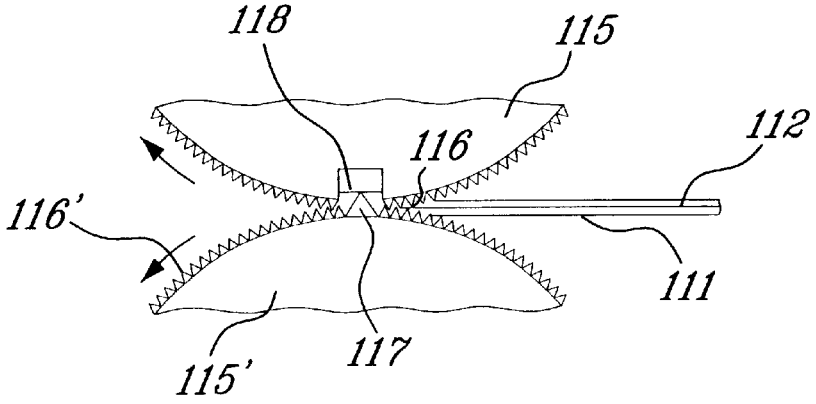
FIG. 18 is a fragmented top view of the vertical crimping disc used for paper straw wrapping.
Figure 19:
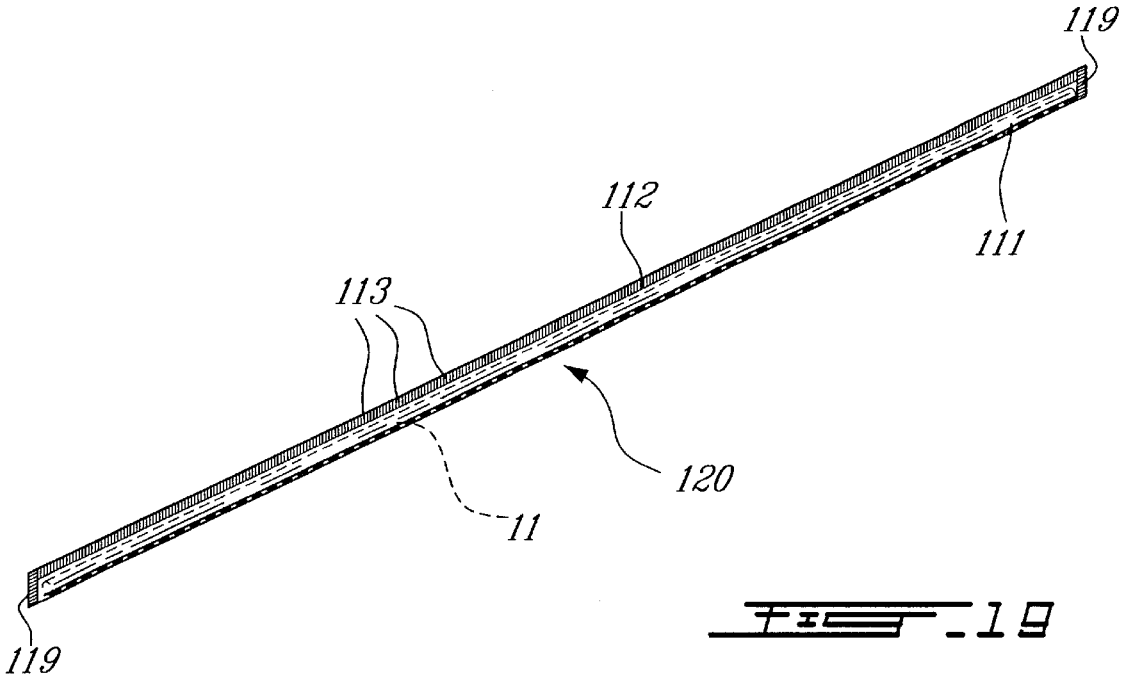
FIG. 19 is a perspective view of a paper wrapped straw produced by the retrofit.

The anvil and knife assembly 35 is also replaced by a set of vertical crimping and severing discs 115 and 115', as shown in FIG. 18. As shown, crimping teeth 116 and 116' are formed in a section only of these discs which is synchronized with portions of the folded paper strip 111 in the area between opposed spaced ends of adjacent straw held captive in the folded strip. Disc 115' is provided with a cutting blade 117 and disc 115 is provided with a backing pad 118 aligned with the blade 117 whereby to sever the folded paper strip 111 in the vertical crimped area. End crimps 119 are thereby formed in the ends of the paper straw wrapper 120 as shown in FIG. 19.

Figure 20:
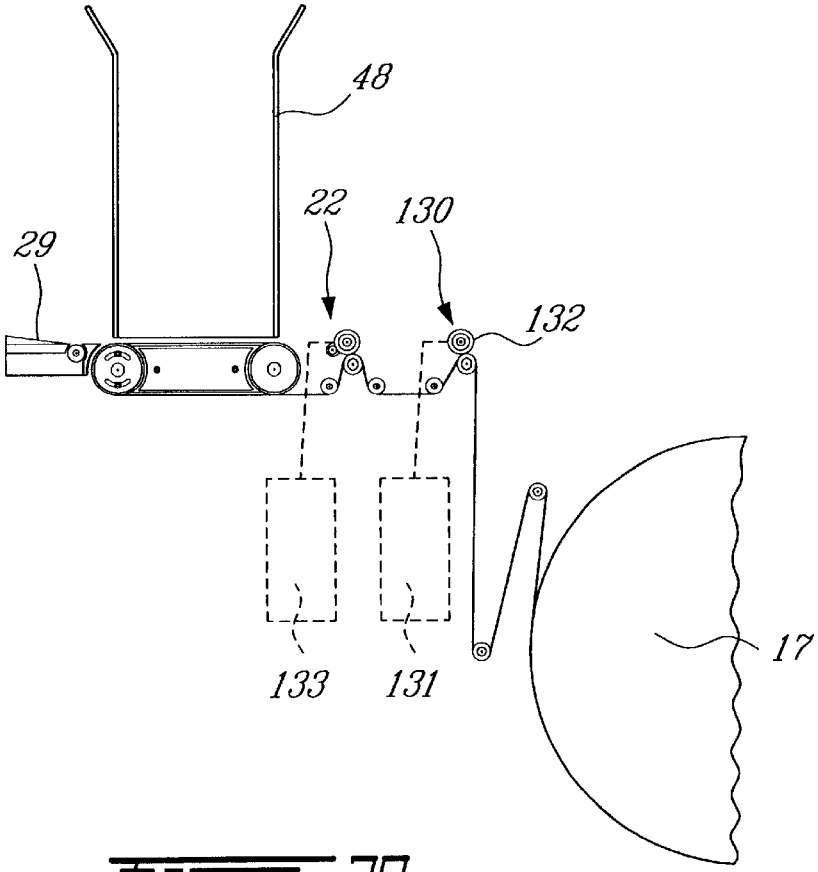
FIG. 20 is a side view of a portion of the machine illustrating the speed controlled film stretching unit.

Referring now to FIG. 20, there is shown a partial view of a modification made to the machine as illustrated in FIG. 1 and wherein there is provided a speed controlled film stretching unit 130 disposed between the supply film roll 17 and the drive sprocket unit 22 whereby to pre-stretch the film a desired percentage to increase the yield of the supply roll 17 and also to weaken the film prior to feeding same under the straw supply bin 48 and into the trough former 29. By stretching the film, the film is weakened whereby to facilitate the removal of the straw from the weakened film wrapper, as illustrated in FIGS. 15 and 16. By stretching the film its properties are changed and the film is artificially weakened. Because it is extremely difficult to fabricate thin films, this improvement in the machine resolves that problem of being unable to fabricate such thin films and to form a narrow roll thereof which has sufficient stability to be used with this type of machine. Another advantage of stretching the thin film is that the supply roll can be made wider and therefore have more stability and by stretching it, the film becomes narrower. The percentage of stretching and the desired characteristics of the film are adjusted in a speed control unit 131 which controls the speed of the driven roll 132 in the speed control driven roll unit 130. It is also pointed out that it is extremely difficult to produce film rolls which are narrower than one inch. Accordingly, the film stretching can produce a wrapper having a film width of ¾ inch from a one inch supply roll. With the machine as thus modified, it is possible to stretch the film sufficiently to increase the yield by 10 to 15 percent and therefore lowering the cost. A wrapper speed controller 133 controls the speed of the film feed roll unit 22 and controls the speed of the machine in parts per minute.

It is within the ambit of the present invention to cover any obvious modifications of the preferred embodiment of the invention as described herein, provided such modifications fall within the scope of the appended claims.

What is claimed is:

1. A machine for wrapping an elongated object with a plastic film, said machine comprising drive means for continuously advancing a narrow thin film strip from a supply means to a wrapper loading and forming means, said wrapper loading and forming means having a trough former for folding said advancing film strip into a film trough, insert means for positioning spaced-apart elongated objects into said film trough of said advancing film strip for engagement and conveyance of said objects by said film trough, object dispensing means for supplying pre-oriented elongated objects to said insert means, sealing and severing means for heat sealing said film trough about individual ones of said elongated objects and severing said film trough between adjacent ends of said elongated objects to form individually wrapped elongated objects;

a film stretching means prior to said trough former, whereby to stretch said film to increase the yield of said supply means and to weaken said film to facilitate the removal of a straw wrapped with said film.

2. A machine as claimed in claim 1 wherein said elongated objects are drinking straws.

3. A machine as claimed in claim 2 wherein said trough former comprises a geometric forming plate having a tapered bottom wall having a flat inlet end and progressively merging opposed side walls tapering to a narrow funnel-shaped rear trough section, and film drawing means spaced from said funnel-shaped rear end through section for pulling said film in folded juxtaposition adjacent a top edge of said film trough formed in said trough former.

4. A machine as claimed in claim 3 wherein said film trough defines a straw engaging section intermediate said flat inlet end and said funnel-shaped rear through section wherein said straw is frictionally engaged by said film.

5. A machine as claimed in claim 4 wherein said film drawing means is constituted by a set of narrow draw rolls in frictional rotating engagement with opposed side walls of said film trough adjacent top edges of said side walls for advancing said film in folded juxtaposition with a straw retained captive between said film side walls under said draw rolls.

6. A machine as claimed in claim 5 wherein said narrow drive rolls are coupled to a draw roll drive which is synchronized with said drive means and said insert means.

7. A machine as claimed in claim 1 said film stretching means is constituted by a speed controlled driven roll unit, and a controller device for adjusting the speed of said driven roll unit depending on a desired percentage of stretch to be applied to said thin film strip.

8. A machine as claimed in claim 2 wherein said plastic film is a co-extruded polyolefin film structure comprising a sealing layer with a seal initiation temperature lower than 90° C. and a core comprising a mixture of low, medium and/or high density polyethylene and/or polypropylene with an approximate thickness of between 0.5 to 0.7 mil.

9. A machine as claimed in claim 2 wherein said dispensing means is a straw dispensing means comprised of a holding bin having spaced parallel side walls, a front wall, a rear wall and a bottom wall; straw feed and alignment means comprising a discharge conveyor having an endless belt with a friction upper surface for conveying said straws into a positioning throat section to locate said straws in side-by-side parallel spaced relationship, said positioning throat section being defined by a buffer wall retained in spaced parallel relationship with at least a section of said friction upper surface of said discharge conveyor, said buffer wall permitting said straws to align themselves in said side-by-side parallel spaced relationship.

10. A machine as claimed in claim 9 wherein said buffer wall is comprised by a plurality of parallel spaced rods secured to a frame in spaced apart relationship and at a predetermined distance therebetween in a common plane disposed substantially parallel to said friction upper surface of said discharge conveyor disposed thereadjacent, and a flexible hollow tubular member disposed about each said rod in a loose spaced relationship therewith, said hollow tubular member having an inner diameter larger than an outer diameter of said rod permitting lateral displacement of said hollow tubular member.

11. A machine as claimed in claim 10 wherein said hollow tubular member is a drinking straw.

12. A machine as claimed in claim 10 wherein said friction upper surface of said discharge conveyor is constituted by a serrated upper surface formed by a plurality of spaced apart rib formations, said discharge conveyor being constituted by a pair of spaced-apart belt conveyors each trained about a drive and an idle pulley mounted on support rods.

13. A machine as claimed in claim 10 wherein said frame is an adjustable frame whereby to position said common plane at a desired position relative to said friction upper surface.

14. A machine as claimed in claim 10 wherein said bottom wall has an inclined wall portion for directing straws to a horizontal straw pick-up section of said discharge conveyor.

15. A machine as claimed in claim 14 wherein there is further provided a feed conveyor disposed on an incline with said inclined wall portion for feeding straws to said discharge conveyor.

16. A machine as claimed in claim 10 wherein said discharge conveyor has a horizontal throat section disposed adjacent said buffer wall and a transverse substantially vertical discharge section extending at an upper end section of a dispensing magazine.

17. A machine as claimed in claim 16 wherein said dispensing magazine defines said straw discharge end at a lower end thereof, said magazine having straw restraining walls disposed in spaced parallel relationship for receiving said straws and maintaining them in parallel side-by-side relationship therealong.

18. A machine as claimed in claim 17 wherein an outer one of said straw retaining walls is constituted by at least two spaced apart guide plates retained in vertical relationship by adjustable support rods adjustably secured at opposed ends between vertical side frame members, said guide plates being adjustably positioned relative to said vertical discharge section of said discharge conveyor in relation to the outer diameter of said straws.

19. A machine as claimed in claim 18 wherein said discharge end is provided with a lower adjustable wall section spaced from said guide plates, said guide plates being brass plates providing a straw engaging surface with a good slip coefficient.

20. A machine as claimed in claim 3 wherein said geometric forming plate is secured to an adjustable positioning frame to adjust the position thereof relative to an inlet roll positioned adjacent said flat inlet end of said forming plate and said draw rolls.

21. A machine as claimed in claim 3 wherein said supply means is comprised of a film strip roll support shaft having core attachment chocks and a core lock ratchet cap for securing a film strip roll on said support shaft, a tension roller secured to a tension control pivot arm having a brake shoe for releasable engagement with a brake hub secured to said support shaft, said tension roller being displaceable in an arcuate guide slot concentric with a pivot connection of said pivot arm, said film strip being trained over said tension roller bearing disposed between said film strip roll and said drive means, said drive means being a drive roll spring-biased against a stationary roll and through which said film strip is disposed for frictional engagement.

22. A machine as claimed in claim 21 wherein said core chocks have at least one replaceable chock to adapt to cores of different widths, said ratchet cap having a pair of ratchet plates to prevent over-tightening of said cap on a threaded end of said film strip roll support shaft.

23. A machine as claimed in claim 4 wherein said insert means is an endless belt loading conveyor driven between a drive sheave and an idle sheave, said endless belt having flat run sections disposed adjacent a straw discharge end of said dispensing means, said dispensing means being a straw dispensing means and two or more pusher plates secured to said endless belt in spaced apart relationship and disposed a predetermined distance from one another, said pusher plates each having a straw end engaging wall for engaging a straw at said discharge end of said dispensing means.

24. A machine as claimed in claim 23 wherein said drive sheave is provided with pusher plate position adjustment means for adjusting the position of said pusher plates dependent on the length of said straws in said dispensing means.

25. A machine as claimed in claim 5 wherein said sealing and severing means comprises a set of narrow heat sealing rolls disposed adjacent said narrow draw rolls for effecting a narrow seal between said opposed side walls of said film trough adjacent said top edge thereof and a transverse seal adjacent opposed end of said straw and severing rolls for severing said film trough between spaced adjacent transverse seals between adjacent straw ends.

26. A machine as claimed in claim 25 wherein there is further provided discharge conveyor means for discharging wrapped straws from said set of severing rolls.

27. A machine as claimed in claim 25 wherein one of said draw rolls is secured to a manual cam operated mechanism for opening said draw rolls to thread a folded upper section of said film strip between said draw rolls, said set of heat sealing rolls having a pneumatic roll separating mechanism, said set of severing rolls being spring-biased against one another.

28. A machine as claimed in claim 25 wherein said set of narrow heat sealing rolls, said set of transverse severing rolls, and said set of narrow draw rolls are belt driven by said drive means and synchronized together said drive means being a drive roll spring biased against a stationary roll.

29. A method of wrapping an elongated object with a thin plastic film, said method comprising the steps of:

i) continuously advancing a narrow thin film strip from a supply roll to a wrapper loading and forming station by drive means, ii) stretching said film to increase the yield of said supply roll and to weaken said film to facilitate the removal of said elongated object wrapped with said film, folding said stretched narrow thin film strip in a trough former to form a film trough having opposed spaced film side walls, iii) inserting spaced-apart elongated objects into said advancing film trough whereby each object is frictionally engaged and conveyed by said film side walls of said film trough, iv) longitudinally sealing a top end portion of said opposed film side walls together and transversely sealing said side walls about said object positioned between said film side walls, v) transversely severing said folded film between opposed ends of said object therein, and vi) discharging individual plastic film wrapped objects.

30. A method as claimed in claim 29 wherein said elongated object is a straw, said step (iii) comprises conveying individual straws from a straw discharge end of a straw holding bin, and feeding said discharge end with straws oriented in side-by-side parallel relationship.

31. A method as claimed in claim 30 wherein said step of feeding said discharge end comprises feeding straws from said holding bin into a positioning throat of a straw alignment mechanism where said straws are held captive and in side-by-side displacement between a friction upper surface of a discharge conveyor and a buffer wall while permitting limited up and down movement of said straws.

32. A method as claimed in claim 29 wherein there is further provided the step of slowing the rotational speed of said supply roll by brake means upon detection of a reduction in speed of said drive means.

* * * * *